United States Patent [19]

Kodama et al.

[11] 4,336,479

[45] Jun. 22, 1982

[54] FLUORESCENT LAMP HAVING REFLECTIVE LAYER AND A METHOD FOR FABRICATING THE SAME

[75] Inventors: Churyo Kodama, Ohme; Taisuke Hirota, Hachioji; Hiroshi Ohno; Etsuo Urataki, both of Ohme, all of Japan

[73] Assignee: Hitachi, Ltd., Tokyo, Japan

[21] Appl. No.: 89,744

[22] Filed: Oct. 31, 1979

[30] Foreign Application Priority Data

Nov. 8, 1978 [JP] Japan ..... 53/136806
Mar. 30, 1979 [JP] Japan ..... 54/36888

[51] Int. Cl.[3] ..... H01J 61/35; H01J 61/48

[52] U.S. Cl. ..... 313/487; 313/113; 313/488

[58] Field of Search ..... 313/487, 486, 488, 493, 313/113, 489, 485

[56] References Cited

U.S. PATENT DOCUMENTS

| | | | |
|---|---|---|---|
| 2,854,600 | 9/1958 | van de Weijer et al. | 313/113 |
| 3,442,582 | 5/1969 | Lahr | 313/488 |
| 4,088,923 | 5/1978 | Manders | 313/487 |
| 4,099,090 | 7/1978 | Corth et al. | 313/487 |

*Primary Examiner*—Ernest F. Karlsen
*Attorney, Agent, or Firm*—Craig and Antonelli

[57] ABSTRACT

A fluorescent lamp with reflective layer of the present invention has a first phosphor layer and a second phosphor layer which are partially laminated. The first phosphor layer is formed on the whole inner surface of the glass tube, and the second phosphor layer is formed on the first phosphor layer at a predetermined angle of reflection along the axial direction of the glass tube. The laminated portions of the first and second phosphor layers substantially form a reflective layer, and the other portions form a transmitting layer.

8 Claims, 12 Drawing Figures

FLUORESCENT LAMP HAVING REFLECTIVE LAYER AND A METHOD FOR FABRICATING THE SAME

BACKGROUND OF THE INVENTION

1. Field of the Invention

The present invention relates to a fluorescent lamp having a reflective layer, and more specifically to a fluorescent lamp having two fluorescent layers partially laminated on the inner wall of a glass tube as well as to a method of fabricating the same.

2. Description of the Prior Art

Ordinary fluorescent lamps have a single phosphor 2 which is substantially uniformly coated on the entire surface of the inner wall of a glass tube 1 as cross-sectionally illustrated in FIG. 1. With such conventional fluorescent lamps, nearly a uniform light distribution can be obtained in the radial direction from the center of the glass tube 1. In practice, however, the luminous flux in the main illuminating direction which is a particular radial direction from the center of the glass tube 1, is utilized. To meet the above purpose, there has been proposed a fluorescent lamp having a reflective layer. As cross-sectionally illustrated in FIG. 2, this type of fluorescent lamp has a reflective coating 3 of titanium oxide on the inner wall of the glass tube 1 on the side opposite to the main illumination direction, and a coating 4 of phosphor formed on the entire inner surface of the glass tube, such that the luminous flux generated in the glass tube 1 is radiated in a concentrated manner through a light-transmitting surface on the lower side of the glass tube 1 to obtain strong illumination intensity beneath the lamp.

There has also been known in the art a lamp which uses apatite as the reflective coating 3 instead of the abovementioned titanium oxide. The apatite absorbs ultraviolet rays in very much smaller amounts than titanium oxide, enabling the luminous efficiency of the lamp to be enhanced. There has also been known in the art a lamp which uses the phosphor itself as the reflective coating 3 in place of titanium oxide. This art is based on the fact that the phosphor absorbs ultraviolet rays to a smaller degree than the titanium oxide contributing to the increase in the luminous efficiency of the lamp, and that the phosphor for forming the reflective coating serves as a phosphor that will be coated on the entire surface in a subsequent step thereby to provide convenience for the manufacturing steps. In all of the above-mentioned conventional lamps, the reflective coating has generally been formed on the inner surface of the glass tube 1 at a predetermined reflecting angle $\theta$, for example, at 230 degrees along the axial direction.

However, the conventional fluorescent lamps having the reflective coating 3 composed of titanium oxide, apatite or phosphor, have problems which are inherent in the manufacturing steps as mentioned below. The steps for manufacturing conventional fluorescent lamps having a reflective layer are described below with reference to the cross-sectional construction of the conventional fluorescent lamp having a reflective layer as illustrated in FIG. 2.

(1) A step for forming the reflective coating 3 by coating a solution of the abovementioned reflective substances on the inner surfaces of the glass tube 1 at an angle of reflection $\theta$.

(2) A step for drying the thus formed reflective coating 3.

(3) A step for baking the dried reflective coating 3.

(4) A step for forming a phosphor coating 4 by coating a solution of phosphor on the entire inner surface of the glass tube 1 inclusive of the baked reflective coating 3.

(5) A step for drying the thus formed phosphor coating 4.

(6) A step for baking the dried phosphor coating 4.

According to the conventional art, the fluorescent lamp with reflective layer having the cross-sectional construction as shown in FIG. 2 must be manufactured through the abovementioned six steps. Particularly, the third step (3) for baking the reflective coating 3 markedly disturbs the productivity of the fluorescent lamps having a reflective layer. In other words, the step for baking the reflective coating 3 requires increased periods of time before the fluorescent lamps with reflective layer are completed, increased costs for facilities such as manufacturing machinery, increased areas and space for installing the facilities, and increased labor force. Therefore, the third step (3); presented great difficulty in regard to not only the productivity but also the manufacturing costs of such a lamp. Particularly, the following problem was presented when a specially obtained reflective substance such as titanium oxide or apatite was used as the reflective coating 3. Namely, when such specially obtained reflective substances were used as the reflective coating 3, the abovementioned step (3) had to effect the baking at a temperature considerably higher than the temperature that was used when the phosphor was used as the reflective coating 3, in order to completely remove a binder such as organic solvent or the like. Moreover, the fluorescent lamps employing the specially obtained reflective substances have encountered such a problem that the step for bending the fluorescent lamps into a circular shape was very difficult.

SUMMARY OF THE INVENTION

The object of the present invention therefore is to provide a novel fluorescent lamp having a reflective layer, which is free of the problems associated with the manufacturing steps mentioned earlier, and a method for fabricating the same.

To achieve the abovementioned object, the fluorescent lamp with a reflective layer in accordance with the present invention consists of a glass tube having electrodes at both ends and containing mercury and a rare gas in suitable amounts, a first phosphor layer formed on the entire inner surface of the glass tube, and a second phosphor layer formed on the first phosphor layer at a predetermined angle of reflection along the axial direction of the glass tube.

According to the above characteristic setup of the present invention, it is possible to eliminate the step for baking the phosphor that is initially coated (i.e., the first phosphor layer) without at all affecting the characteristics of the lamps. Namely, according to the method of making fluorescent lamps with a reflective layer of the type to which the present invention is directed, only a single baking step is required as compared with two baking steps required for the prior art. With the conventional method of making fluorescent lamps with a reflective layer, a time of about 50 minutes was required from the step for initially coating the phosphor to the step for finally baking the phosphor. According to the method of making fluorescent lamps with a reflective layer as provided by the present invention, on the other hand, the required time can be reduced to about 30 minutes. In effect, the manufacturing time can be reduced by about 20 minutes. Moreover, the method of making fluorescent lamps with a reflective layer in accordance with the present invention does not at all require the operation for returning the glass tube from the step of initially baking the phosphor to the next step of coating the phosphor, that is required in the conventional methods of making fluorescent lamps with a reflective layer. Consequently, machines and facilities, required floor areas and labor forces can be reduced, contributing to the increase in the productivity and a decrease in manufacturing cost.

DESCRIPTION OF THE PREFERRED EMBODIMENTS

Figure 3A:
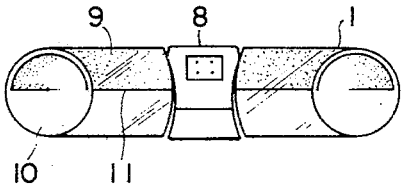
FIGS. 3A and 3B are a front view illustrating in a partially cut-away manner an annular fluorescent lamp with reflective layer according to the present invention, and a cross-sectional view thereof on an enlarged scale.
Figure 3B:
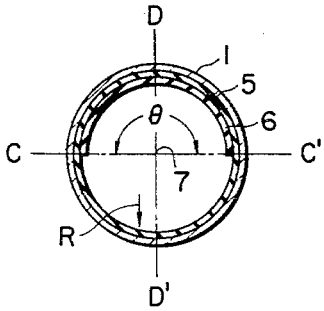

FIG. 3A shows, partly in cross section, the annular fluorescent lamp with a reflective layer in accordance with the present invention. FIG. 3B shows in detail the cross-sectional portion. Referring to FIGS. 3A and 3B, electrodes (not shown) are provided at both ends (on the inner side of a cap 8) of a glass tube 1 which is formed in an annular shape, and mercury and a rare gas are contained in suitable amounts in the glass tube 1. Up to this stage, the fluorescent lamp of the present invention is not different from an ordinary annular fluorescent lamp. According to the present invention, however, a novel cross-sectional construction in the glass tube 1 is provided as illustrated in FIG. 3B. That is, a first phosphor layer 5 is provided on the whole inner surface of the glass tube 1. Further, a second phosphor layer 6 is provided on the first phosphor layer 5 over a restricted area at an angle of reflection $\theta$ along the axial direction of the glass tube 1. Here, a portion where the first phosphor layer 5 and the second phosphor layer 6 are laminated is referred to as a reflective layer 9, a portion of the first fluorescent layer 5 only is referred to as a transmitting layer 10, and a boundary between the reflective layer 9 and the transmitting layer 10 is referred to as a boundary line 11. The angle of reflection $\theta$ is so determined that the reflective layer 9 is divided toward the right and left each by an equal angle, i.e., each by an angle of $\theta/2$ with a perpendicular axis D—D' as a center. Therefore, the direction of main illumination is perpendicularly headed toward the lower direction opposite to the second fluorescent layer 6 as indicated by an arrow R.

Figure 4A:
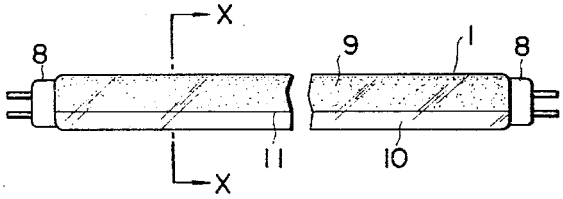
FIGS. 4A and 4B are a front view illustrating a straight fluorescent lamp with reflective layer according to the present invention, and an enlarged cross-sectional view thereof along the line X—X of FIG. 4A.
Figure 4B:
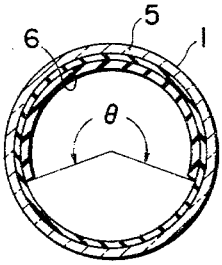

FIG. 4A shows a straight fluorescent lamp with reflective layer according to the present invention. FIG. 4B is a cross-sectional view illustrating the fluorescent lamp with reflective layer along the line X—X in FIG. 4A. Like the annular fluorescent lamp with a reflective layer in accordance with the present invention illustrated in FIGS. 3A and 3B, the straight fluorescent lamp has the feature in the cross-sectional construction of the glass tube 1 as illustrated in FIG. 4B. The difference between the cross-sectional construction shown in FIG. 4B and that of FIG. 3B is only with regard to the angle of reflection $\theta$ of the reflective layer 9, which is different, i.e., the angle $\theta$ of the coating the second phosphor layer 6 is different.

Figure 1:
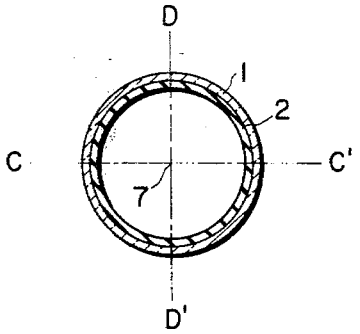
FIG. 1 PRIOR ART
FIG. 1 is a cross-sectional view illustrating, on an enlarged scale, a conventional fluorescent lamp.
Figure 5:
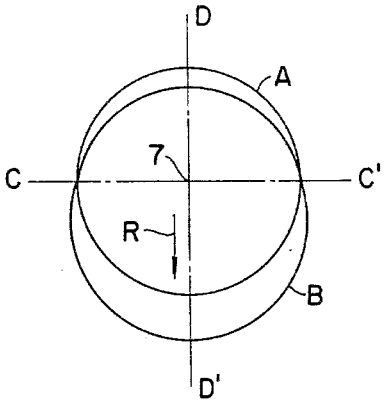
FIG. 5 is a diagram illustrating luminous intensity distribution curves of the annular fluorescent lamp with reflective layer of the present invention shown in FIGS. 3A and 3B.

FIG. 5 shows light distributions on a plane inclusive of axes C—C' and D—D' in the cross section of the glass tube 1, obtained from a conventional annular fluorescent lamp as illustrated in FIG. 1 and an annular fluorescent lamp with a reflective layer in accordance with the present invention shown in FIG. 3B. With reference to FIG. 5, the ordinary annular fluorescent lamp exhibits a luminous intensity distribution curve A which is substantially quite the same in all directions with respect to the center 7 of the glass tube 1. On the other hand, the annular fluorescent lamp of the present invention exhibits a luminous intensity distribution curve B which has high luminuous intensity toward the direction of main illumination R. This is due to the fact that the inner wall of the glass tube 1 on the side opposite to the direction of main illumination R serves as the reflective layer 9 whereby the light generated through the phosphor is reflected by the inner side of the glass tube 1, passes through the transmitting layer 10, and is radiated toward the direction of main illumination R.

A more specific description will now be provided relating to the difference between the fluorescent lamp with reflective layer of the present invention and the conventional fluorescent lamp with reflective layer. As will be obvious from the comparison of the cross section of the fluorescent lamp of the present invention shown in FIG. 3B or FIG. 4B with the conventional fluorescent lamp having a reflective layer shown in FIG. 2, the reflective coating 3 made of the phosphor is just replaced by the phosphor coating 4 in FIG. 3.

That is, the present invention presents the below-mentioned merits in regard to the manufacturing steps. Below are illustrated the steps for manufacturing the fluorescent lamps with reflective layer of the present invention with reference to the cross section shown in FIG. 3B or FIG. 4B.

(1) A step for forming a first phosphor layer 5 by coating a phosphor which is slightly more dilute than a general phosphor suspension on the whole inner surfaces of the glass tube 1.

(2) A step for drying the thus coated first phosphor layer 5 in an atmosphere heated at 20° to 100° C.

(3) A step for forming a second phosphor layer 6 by coating a phosphor suspension having a viscosity nearly equal to that of the first phosphor layer at an angle of reflection $\theta$ on the surface of the first phosphor layer 5 with the dried first phosphor layer 5 being unbaked.

(4) A step for drying the thus coated second phosphor layer 6 in an atmosphere heated at 20° to 100° C.

(5) A step for baking the first and second phosphor layers 5, 6 in a baking furnace.

According to the present invention as mentioned above, the fluorescent lamps with reflective layer can be manufactured through the five steps. According to the conventional art, on the other hand, the fluorescent lamps with reflective layer having a cross section shown in FIG. 2 were manufactured through six steps as mentioned earlier. The difference in the number of manufacturing steps stems from the presence or absence of the baking step (hereinafter referred to as a first layer baking step) which is effected after the first phosphor layer has been formed. The first layer baking step is omitted for the first time by changing the cross-sectional construction of the conventional fluorescent lamp with reflective layer shown in FIG. 2 into the cross-sectional construction of the fluorescent lamp with reflective layer of the present invention as shown in FIG. 4B. The reasons are mentioned below in detail based on experimental results.

First, the fluorescent lamps with reflective layer of the following four types are prepared.

Type A: This lamp has the cross-sectional construction equal to that of the conventional fluorescent lamp with reflective layer shown in FIG. 2. The manufacturing steps include the first layer baking step.

Type B: This lamp has the cross-sectional construction equal to that of the conventional fluorescent lamp with reflective layer shown in FIG. 2. The manufacturing steps, however, do not include the first layer baking step.

Type C: This lamp has the cross-sectional construction equal to that of the fluorescent lamp with reflective layer of the present invention shown in FIG. 4B. The first layer baking step is included in the manufacturing steps.

Type D: This lamp has the cross-sectional construction equal to that of the fluorescent lamp with reflective layer of the present invention shown in FIG. 4B. The first layer baking step, however, is not included in the manufacturing steps.

Figure 6A:
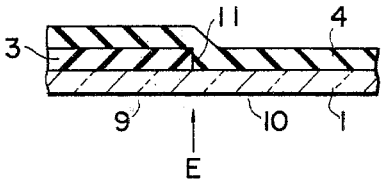
FIGS. 6A to 6D are diagrams for illustrating the difference in appearance depending upon the presence or absence of the step for initially baking the phosphor coating in producing the phosphorescent lamps with reflective layer according to the present invention.

FIGS. 6A to 6D are cross-sectional views illustrating, on an enlarged scale, the vicinity of boundary lines 11 of fluorescent lamps with reflective layer of the types A to D. The fluorescent lamps with reflective layer of the types A to D are turned on, respectively, and the vicinity of boundary line 11 between the reflective layer 9 and the transmitting layer 10 is observed by naked eyes from the direction of an arrow E. The state in which the boundary line 11 can be distinctly observed is judged to be "appearance is good", and the state in which the presence of boundary line 11 is difficult to recognize (the state in which the width of deformation W is greater than 2 mm in FIG. 6B) is judged to be "appearance is poor". The results were as follows:

Type A (FIG. 6A): appearance is good
Type B (FIG. 6B): appearance is poor
Type C (FIG. 6C): appearance is good
Type D (FIG. 6D): appearance is good As a result of the visual observation, the fluorescent lamp with reflective layer of the type B only was judged to be "appearance is poor". The quest for this reason led us to the following conclusion. With the lamp of the type A, the layer 3 has been baked. Therefore, when observed from the direction E as shown in FIG. 6A, the boundary line 11 can be clearly distinguished. In the case of the lamp of the type B shown in FIG. 6B, however, the layer 3 has not been baked. Therefore, the edge of the layer 3 is affected and dissolved by the binder contained in the layer 4 that is coated at a subsequent step, so that the boundary line 11 becomes ambiguous. The width of deformation W was about 10 mm as measured from a portion that was to be the edge.

Figure 6B:
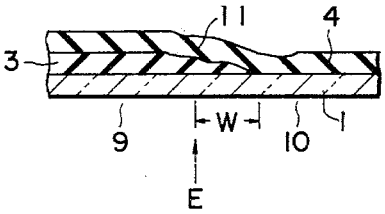
Figure 6C:
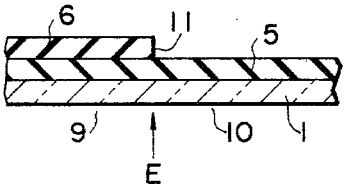
Figure 6D:
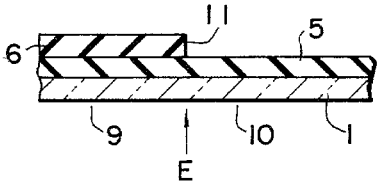

On the other hand, the lamps of the types C and D having the cross section equal to that of the fluorescent lamp with reflective layer of the present invention shown in FIG. 4B, do not at all exhibit the effect caused by the baking of the layer 5, as illustrated in FIGS. 6C and 6D. This is attributed to the fact that even when the layer 5 is not baked, the surface tension of the layer 6 or the layer 6 coated only on a portion of the layer 5 does not develop deformation at the edge of the layer 6. Consequently, the boundary line 11 can be clearly observed from the direction E. From the foregoing experimental results, it will be recognized that the first layer baking step can be omitted from the manufacturing steps only when the fluorescent lamp with reflective layer has a cross-sectional construction as contemplated by the present invention, which is shown in FIG. 4B. It was also learned that the lamp of the type B shown in FIG. 6B presented problems due to the deformation not only in regard to the appearance thereof but also in regard to the characteristics of luminous intensity and vertical illuminance to some extent.

Below is more specifically described the method of producing fluorescent lamps with reflective layer in accordance with the present invention.

50 Kg of an Sb, Mn activated calcium halophosphate phosphor is mixed into 70 liters of a 1.0% nitrocellulose lacquer, and the mixture is pulverized by a ball mill for 1 hour to prepare a suspension. The suspension is coated on the entire inner surface of a glass tube 1 to form a first phosphor layer 5 (coated in an amount of about 3.8 mg/cm$^2$) (step 1). Thereafter, the first phosphor layer 5 is dried in an atmosphere heated at 20° to 100° C. (step 2). The phosphor suspension is then coated on the surface of the first phosphor layer 5 at an angle of reflection of about 230 degrees to form a second phosphor layer 6 (coated in an amount of about 3.8 mg/cm$^2$) (step 3). Then, the second phosphor layer 6 is dried in an atmosphere heated at 20° to 100° C. (step 4). Finally, the first and second phosphor layers 5, 6 are baked in a baking furnace at about 600° C. for about 5 minutes (step 5). Thereafter, the glass tube 1 is mount-sealed, the air is evacuated, mercury is introduced, rare gas is introduced, and the exhaust tube is sealed in the customary manner, thereby to complete a fluorescent lamp with reflective layer.

Below is mentioned the performance of the fluorescent lamp with reflective layer of the present invention.

The fluorescent lamp with reflective layer (type D) produced in accordance with the abovementioned embodiment, the conventional fluorescent lamp with reflective layer (type A, the coating amount of the phosphor and the angle of reflection are the same as those of the abovementioned embodiment), and the conventional fluorescent lamp (phosphor is coated in an amount of about 4.6 mg/cm$^2$) shown in FIG. 1, each being of the 40 W type, were compared in regard to their performance. The vertical illuminance at a point beneath the lamp separated by 3 meters from the center thereof was 140 luxes in the case of the fluorescent lamp with reflective layer (type D) of the present invention, 125 luxes in the case of the conventional fluorescent lamp with reflective layer (type A), and 100 luxes in the case of the conventional fluorescent lamp (FIG. 1). It will therefore be recognized that the fluorescent lamp with reflective layer of the present invention presents such an advantage that the first layer baking step can be omitted from the manufacturing steps as well as the advantage that the lamp gives increased vertical illuminance as compared with the conventional fluorescent lamps with reflective layer.

Figure 7:
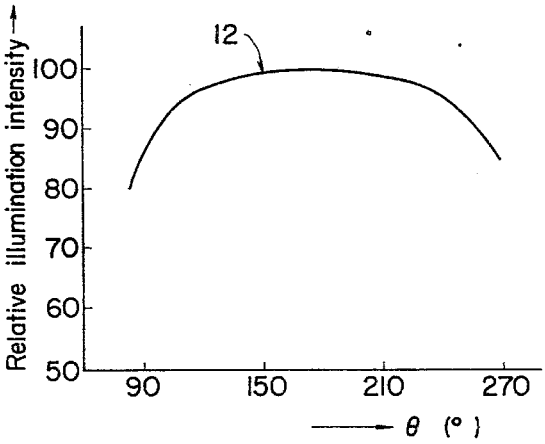
FIG. 7 is a graph showing a relation between angles of reflection and relative illumination intensities of the annular fluorescent lamp with a reflective layer in accordance with the present invention.

FIG. 7 illustrates the change in relative illumination intensity (relative illumination intensity being set at 100 when the angle of reflection $\theta$ is 180 degrees) when the angle of reflection $\theta$ is varied in the fluorescent lamp of the present invention. As will be obvious from the locus of a curve 12, when the angle of reflection $\theta$ lies over a range of 180° to 0°, the relative illumination intensity gradually decreases with the decrease in the angle of reflection $\theta$. In particular, the relative illumination intensity drastically decreases when the angle of reflection $\theta$ decreases below 120°. On the other hand, when the angle of reflection $\theta$ lies over a range of 180° to 360°, the relative illumination intensity gradually decreases with the increase in the angle of reflection $\theta$, and drastically decreases when the angle of reflection $\theta$ exceeds 240°. Accordingly, the angle of reflection $\theta$ should lie within a range of 120° to 240°.

In the abovementioned steps for producing fluorescent lamps with reflective layer of the present invention, the first phosphor layer 5 and the second phosphor layer 6 are made of the same composition, i.e., have the same emission spectrum. This gives an advantage with regard to the manufacturing cost, since the first and the second phosphor layers 5 and 6 are made of the same material. However, the first and the second phosphor layers 5 and 6 need not be made of the material having the same emission spectrum, but may be made of materials having dissimilar emission spectra. In this case, it is possible to enhance not only the vertical illuminance but also the color rendering properties owing to the mixing of colors. Below are mentioned the effects relying upon specific experimental results.

The phosphors employed for the experiments give such colors as white, daylight, warm white, and improved color rendering thereof such as super deluxe type, as stipulated under JIS-Z-9112 (chromaticity classification of fluorescent lamps). From the standpoint of composition, these phosphors have peaks of emission spectra near 480 nm and 580 nm. These phosphors are obtained by mixing an Mn, Sb activated calcium halophosphate, an Sn activated Sr, Mg orthophosphate, an Mn activated zinc silicate or an Mn activated fluorogermanate in suitable amounts with calcium halophosphate. In recent years, there has been proposed a new phosphor which gives a color of the type of super deluxe type, and which is activated with rare earth elements to synthesize a plurality of narrow band spectra.

Figure 2:
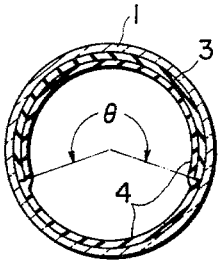
FIG. 2 PRIOR ART
FIG. 2 is a cross-sectional view illustrating, on an enlarged scale, a conventional fluorescent lamp with a reflective layer.

Table 1 shows performance of fluorescent lamps with reflective layer of the present invention having a combination of the first and the second phosphor layers 5, 6 of dissimilar emission spectra. The lamps used for the experiments are annular fluorescent lamps of the 30 W type. For the purpose of comparison, Table 1 also shows the performance of the conventional annular fluorescent lamp having a cross-sectional construction as shown in FIG. 1 and the conventional annular fluorescent lamp with reflective layer having a cross-sectional construction as shown in FIG. 2. The first-layer phosphor refers to a phosphor which is initially coated on the inner surfaces of the glass tube 1, and the second-layer phosphor refers to a phosphor which is coated on the first-layer phosphor. Here, both the first-layer phosphor and the second-layer phosphor are coated in an amount of 3.5 mg/cm$^2$, and the angle of reflection $\theta$ is 180 degrees. Further, the relative illumination intensity refers to the illumination intensity in the direction of main illumination R of the annular fluorescent lamps with reflective layer with reference to an illumination intensity 100 of the conventional annular fluorescent lamps using white phosphor as the first-layer phosphor.

TABLE 1

| Lamp No. | Cross-sectional construction | First-layer phosphor | Second-layer phosphor | Relative illumination intensity | Mean color rendering index |
|---|---|---|---|---|---|
| 1 | FIG. 1 | White | | 100 | 64 |
| 2 | FIG. 3B | White | White | 130 | 64 |
| 3 | " | Super deluxe | Super deluxe | 83 | 90 |
| 4 | " | White | Super deluxe | 120 | 80 |
| 5 | " | Super deluxe | White | 105 | 85 |
| 6 | " | Daylight | Super deluxe | 108 | 86 |
| 7 | " | Super deluxe | Daylight | 100 | 88 |
| 8 | FIG. 2 | White | Super deluxe | 86 | 85 |
| 9 | " | Super deluxe | White | 110 | 67 |

In Table 1, the lamp No. 1 is an ordinary fluorescent lamp using a white phosphor, which produces a relative illumination intensity of 100, and a mean color rendering index of 64. The lamp No. 2 is an annular fluorescent lamp with reflective layer according to the present invention having the first layer and the second layer made of a white phosphor and, hence, having the same emission spectrum. The lamp has a reflective layer and produces a relative illumination intensity of 130. However, since the same phosphor has been used for the first and the second layers, the mean color rendering index is 64 which is the same as that of the lamp No. 1. The lamp No. 3 is an annular fluorescent lamp with reflective layer of the present invention having the first and the second layers of the phosphor of the super deluxe type and, hence, having the same emission spectrum. Since this phosphor produces, by its own nature, the brightness which is less intense than that of the white phosphor, the fluorescent lamp with reflective layer made of this phosphor produces a relative illumination intensity which is as small as 83. However, the mean color rendering index is as high as 90. This is the result naturally stemming from the use of a phosphor having good color rendering properties. Namely, when the first layer and the second layer are made of the same phosphor to exhibit the same emission spectrum, it is difficult to satisfy both requirements, i.e., it is difficult to attain high relative illumination intensity as well as high mean color rendering index.

On the other hand, the lamps No. 4 to No. 7 are fluorescent lamps with reflective layer obtained according to the present invention, having the first layer and the second layer made of phosphors with dissimilar emission spectra. The relative illumination intensity of these lamps range from 100 to 120, and the mean color rendering index ranges from 80 to 88. It will be understood from these results that when the first layer and the second layer are made of phosphors having dissimilar emission spectra, the annular fluorescent lamp produces the relative illumination intensity greater than that of the ordinary annular fluorescent lamps as well as the mean color rendering index which is considerably greater than that of the conventional fluorescent lamps.

The lamps Nos. 8 and 9 are the conventional annular fluorescent lamps with reflective layer having the first layer and the second layer made of phosphors which exhibit different emission spectra. However, as will be obvious from the tabulated performance of the lamps, the presence of the first-layer phosphor does not help enhance the performance. In other words, the combination of different phosphors does not help increase the color rendering properties and illumination intensity, simultaneously.

Below is mentioned with reference to the amount of coating the first-layer phosphor and the second-layer phosphor in the fluorescent lamp with reflective layer of the present invention. It is desired that the phosphors of the first and second layers should be coated in amounts over a range of 1.5 to 5.0 mg/cm$^2$. The reason is because when the coating amount of the phosphor is smaller than 1.5 mg/cm$^2$, the luminous flux is greatly deteriorated in the transmitting layer 10. On the other hand, when the coating amount of the phosphor is greater than 5.0 mg/cm$^2$, the illumination intensity is saturated. Namely, the phosphor is wastefully used giving disadvantage in economy. Moreover, the phosphor coating loses the strength and may peel off.

Furthermore, according to the fluorescent lamps with reflective layer of the present invention, since the first and the second layers are made of phosphors, the glass tube can be bent during the step of manufacturing almost in the same manner as the step of bending conventional fluorescent lamps.

As mentioned in the foregoing, the fluorescent lamps with reflective layer of the present invention can be manufactured through reduced number of steps, and exhibit excellent appearance and vertical illuminance. Consequently, fluorescent lamps with reflective layer having high performance can be produced at reduced manufacturing cost.

What is claimed is:

1. A fluorescent lamp comprising a glass tube having electrodes sealed in both ends thereof and containing mercury and a rare gas in suitable amounts, a first layer of phosphor formed on the entire inner surface of said glass tube, and a second layer of phosphor formed on said first layer of phosphor and restricted to an area subtended by a predetermined angle of less than 360° along the circumference as seen in axial cross section and extending in the axial direction along substantially the entire length of said glass tube.

2. A fluorescent lamp with reflective layer according to claim 1, wherein said predetermined angle ranges from 120 to 240 degrees.

3. A fluorescent lamp with reflective layer according to claim 1, wherein the phosphor forming said first layer of phosphor has the same emission spectrum as the phosphor which forms said second layer of phosphor.

4. A fluorescent lamp with reflective layer according to claim 1, wherein the phosphor forming said first layer of phosphor has an emission spectrum different from that of the phosphor which forms said second layer of phosphor.

5. A fluorescent lamp with reflective layer according to claim 1, wherein the phosphors of said first and second layers are coated in an amount of 1.5 to 5.0 mg/cm$^2$, respectively.

6. A fluorescent lamp with reflective layer according to claim 1, wherein said glass tube is of a linear shape.

7. A fluorescent lamp with reflective layer according to claim 1, wherein said glass tube is of a curved shape.

8. A fluorescent lamp comprising a glass tube having electrodes sealed in both ends thereof and containing mercury and a rare gas in suitable amounts, a first layer of phosphor formed on the entire inner surface of said glass tube, and a second layer of phosphor formed on said first layer of phosphor and restricted to an area subtended by a predetermined angle of less than 270° along the circumference as seen in axial cross section and extending in the axial direction along substantially the entire length of said glass tube.

* * * * *